US007005787B2

(12) United States Patent
Hsiao et al.

(10) Patent No.: US 7,005,787 B2
(45) Date of Patent: Feb. 28, 2006

(54) ANODIC BONDING OF SPACER FOR FIELD EMISSION DISPLAY

(75) Inventors: Ming-Chun Hsiao, Hsinchu (TW); Cheng-Chung Lee, Hsinchu (TW); Yu-Yang Chang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 97 days.

(21) Appl. No.: 10/739,077

(22) Filed: Dec. 19, 2003

(65) Prior Publication Data

US 2004/0130261 A1 Jul. 8, 2004

Related U.S. Application Data

(63) Continuation-in-part of application No. 09/767,918, filed on Jan. 24, 2001, now abandoned.

(51) Int. Cl.
*H01J 29/70* (2006.01)

(52) U.S. Cl. ..... 313/422; 313/495

(58) Field of Classification Search ..... 313/495–497, 313/422, 288–292, 238, 611–612
See application file for complete search history.

(56) References Cited

U.S. PATENT DOCUMENTS 5,717,287 A 2/1998 Amrine et al. ..... 313/495
5,770,919 A 6/1998 Tjaden et al. ..... 393/495
5,773,927 A 6/1998 Zimlich ..... 313/495
5,949,184 A * 9/1999 Ohoshi et al. ..... 313/485
5,990,614 A 11/1999 Spindt ..... 313/495
6,242,865 B1 6/2001 Zimlich ..... 315/169.3
6,262,528 B1 7/2001 Kim ..... 313/495
6,342,754 B1 1/2002 Kuroda et al. ..... 313/292
6,491,561 B1 12/2002 Kim ..... 445/24
6,517,399 B1 2/2003 Ito et al. ..... 445/24
6,756,729 B1 * 6/2004 Na et al. ..... 313/496
6,840,832 B1 * 1/2005 Suzuki et al. ..... 445/5
6,863,585 B1 * 3/2005 Yang et al. ..... 445/24

* cited by examiner

*Primary Examiner*—Joseph Williams
*Assistant Examiner*—Dalei Dong
(74) *Attorney, Agent, or Firm*—Bacon & Thomas, PLLC

(57) ABSTRACT

This invention is an improved processing method and structure for the packaging technique of a large size field emission display. A large size field emission display includes an indium-tin oxides (ITO) conducting glass substrate, which is covered by the first screen mask and the second screen mask defined to a BM layer area, a multi-phosphor layer area and a hollow area. Each area was coated to form an Al layer, which was formed an $AlO_x$ layer through a phosphor sintering process. The spacer was fixed in a hollow area of an $AlO_x$ layer through an anodic assembling technique. The next plate was fixed on the spacer to accomplish an aligner process.

11 Claims, 10 Drawing Sheets

Fig. 7

| An anodic bonding process of the upper plate* and the spacer** of the present invention | | | | | |
|---|---|---|---|---|---|
| current | time (sec) | | | | |
| (μA) | 300℃ (1.23V/μm) | 250℃ (1.23V/μm) | 200℃ (1.23V/μm) | 300℃ (0.91V/μm) | 250℃ (0.91V/μm) |
| 0 | 115.40 | 49.18 | 18.88 | 79.23 | 27.62 |
| 20 | 122.00 | 69.22 | 21.47 | 104.8 | 38.91 |
| 40 | 94.70 | 61.58 | 18.33 | 81.27 | 33.89 |
| 60 | 81.91 | 53.31 | 19.91 | 60.02 | 26.81 |
| 80 | 64.26 | 46.11 | 19.76 | 48.01 | 21.32 |
| 100 | 53.57 | 40.95 | 16.65 | 39.57 | 17.57 |
| 120 | 44.82 | 36.02 | 14.71 | 33.02 | 14.39 |
| 140 | 40.01 | 31.89 | 13.41 | 26.65 | 12.16 |
| 160 | 34.54 | 29.69 | 12.56 | 22.58 | 10.66 |
| 180 | 30.47 | 27.14 | 11.96 | 19.34 | 9.38 |
| 200 | 27.03 | 25.10 | 11.60 | 16.87 | 7.61 |
| 220 | 25.05 | 23.52 | 11.37 | 14.91 | 6.95 |
| 240 | 22.85 | 22.28 | 11.07 | 13.52 | 6.33 |
| 260 | 21.01 | 21.24 | 10.60 | 12.27 | 5.81 |
| 280 | 19.53 | 21.44 | 10.20 | 11.07 | 5.35 |
| 300 | 18.34 | 22.16 | 10.11 | 10.36 | 4.99 |
| 320 | 17.34 | 22.71 | 9.40 | 9.58 | 4.62 |
| 340 | 16.34 | 22.68 | 9.00 | 9.06 | 4.45 |
| 360 | 15.78 | 22.63 | 7.67 | 7.67 | 4.23 |
| 380 | 15.19 | 22.65 | 6.87 | 7.34 | 4.00 |
| 400 | 14.62 | 22.61 | 6.31 | 7.15 | 3.76 |
| 420 | 13.96 | 22.30 | 5.81 | 6.77 | 3.56 |
| 440 | 13.45 | 21.96 | 5.38 | 6.61 | 3.36 |
| 460 | 12.81 | 21.66 | 10.98 | 6.41 | 3.18 |
| 480 | 12.66 | 21.22 | 13.72 | 6.09 | 3.07 |

Fig. 7 con.

| | | | | | |
|---|---|---|---|---|---|
| 500 | 11.96 | 20.89 | 12.78 | 5.88 | 2.91 |
| 520 | 11.42 | 20.17 | 11.94 | 5.68 | 2.75 |
| 540 | 11.14 | 19.21 | 11.16 | 5.51 | 2.58 |
| 560 | 10.81 | 17.89 | 10.45 | 5.23 | 2.45 |
| 580 | 10.30 | 16.83 | 9.90 | 5.00 | 2.39 |
| 600 | 9.83 | 15.88 | 9.36 | 4.68 | 2.29 |
| 620 | 9.53 | 14.68 | 8.23 | 4.48 | 2.20 |
| 640 | 9.92 | 13.80 | 8.02 | 4.54 | 2.12 |
| 660 | 10.27 | 13.22 | 7.89 | 4.35 | 2.06 |
| 680 | 11.22 | 12.67 | 7.64 | 4.24 | 2.00 |
| 700 | | 12.15 | 7.43 | 4.15 | 1.93 |
| 720 | | 11.57 | 7.16 | 3.97 | 1.85 |
| 740 | | 11.29 | 7.13 | 3.71 | 1.79 |
| 760 | | 10.99 | 7.02 | 3.60 | 1.67 |
| 780 | | 10.55 | 6.76 | 3.54 | 1.62 |
| 800 | | 10.20 | 6.41 | 3.38 | 1.58 |
| 820 | | 9.95 | 6.24 | 3.29 | 1.55 |
| 840 | | 9.68 | 5.94 | 3.28 | 1.49 |
| 860 | | 9.28 | 5.80 | 3.15 | 1.44 |
| 880 | | 7.91 | 5.61 | 3.06 | 1.39 |
| 900 | | 7.79 | 5.45 | 2.90 | 1.32 |
| 920 | | 7.54 | 5.30 | 2.73 | 1.32 |
| 940 | | 7.39 | 5.17 | 2.72 | 1.29 |
| 960 | | 7.29 | 5.09 | 2.62 | 1.27 |

* The upper layer comprises of an ITO conducting glass 11, manufacture by Asahi Japan, 470mm in length, 370mm in width, and 1.1mm in thickness; a BM layer area 14 and a multi-phosphor layer area 15, in which the thickness is 10 μm; the thickness of an Al layer 17 is 3000 angstroms; the thickness of an $AlO_x$ layer 18 is 200 angstroms; the depth of the hollow area 16 is about 10 μm; the thickness of $Cr/CrO_x$ layer 20 is 3000 angstroms.

**The spacer is a glass material possessing the cross-sectional view of a cross column structure, in which the height is 1.1 mm, the thickness is 80 μm, and the length of each arm of the cross is 1.0 mm.

ANODIC BONDING OF SPACER FOR FIELD EMISSION DISPLAY

This is a CIP application of Ser. No. 09/767,918, filed on Jan. 24, 2001, entitled AN IMPROVED PACKAGING TECHNIQUE OF A LARGE SIZE FED, now abandoned)

BACKGROUND OF THE INVENTION

This invention is to provide an improved processing method and structure for the packaging technique of a large size field emission display. The spacer was efficiently fixed on the upper plate through an anodic assembling technique to save the processing and its thickness.

The screen of various electrical equipments such as computer, television, and cellular phone is the best communication bridge between person and electrical equipment. The cathode ray tube (CRT) has been the principal device in the past years since it demonstrates rich color, high resolution, brightness, high contrast, wide viewing angles, rapid speed, and cheapness. But the requirements of today's screen are not only for high-resolution, natural color, light thin volume, low radiation, and low electricity consumption; but also the more important requirement is to satisfy the mobile demand such as cellular phone and automobile display. Thus, the development of CRT screen was limited very much.

Replacements of CRT screen are like liquid crystal display (LCD), electro luminescent display (ELD), plasma display panel (PDP), vacuum fluorescent display (VFD) etc. Most of them are very expensive and are not very efficient except LCD. But LCD still has the following limitations:

1. Point distance is too long, picture is not soft;
2. Reaction is too slow, ghost shadow is easily formed;
3. Brightness is not enough, not suitable for the outdoors use.

Hence, it needs not only to have all advantages of LCD, but also to overcome all limitations described above to satisfy all requirements of screen.

Field emission display (FED) has not only soft picture, rapid reaction, and clear brightness like CRT, but also possesses characteristics of lightness of flat display and low performance consumption.

An upper plate called anode plate and a lower plate called cathode plate assemble FED. Having processed the upper plate and the lower plate, then assembling these two plates, the formation of the space between the upper plate and the lower plate was vacuumed to $10^{-5}$~$10^{-7}$ torr and readily for the next process.

The size of FED increases resulting the center of glass flat of the vacuumed space between the upper plate and lower plate becomes very hard and fragile due to the atmosphere pressure. In order to solve this problem we put multiple spacers at the suitable positions between the upper plate and the lower plate to increase the tolerance of glass flat for the atmosphere pressure, also to decrease the fragile possibility of the glass flat.

FIG. 1 show a conventional FED device, after the processing of the upper plate 1 the spacers 2 were fixed on the upper plate 1, then proceeding the aligner process of the upper plate 1 and lower plate 3. There are two methods for the fixing of spacers 2 on the upper plate 1 as follows:

1. As shown in FIG. 2, after the processing of the upper plate 1, the binding layer 12 was put on the upper plate 1, then, the spacers 2 were bonded on the binding layer 12.

2. As shown in FIG. 3, after the processing of the upper plate 1 increasing one more process in which the formation of the slots 13 was on the upper plat 1 and the spacers 2 were bound on the slots 13.

Methods described above show the fixing of the spacers 2 on the upper plate 1, but the limitations are as follows:

1. Both of methods need to increase the process and the cost.
2. The fixing of the binding layer 12 on the spacers 2 will increase the thickness of FED due to the binding layer 12.
3. In the method of the fixing of the spacers 2 using the slots 13, the spacers 2 were only bonded on the upper plate 1; the spacers 2 will drop off during the aligner process of the upper plate and the lower plate due to vibration of the moving process and the other unpredictable strength.

SUMMARY OF THE INVENTION

Hence, the object of this invention is to provide the improved structure of the packaging technique for a large FED. It is very sufficient that the spacers were fixed on the upper plate and were not dropped off before the proceeding of the aligner process.

The another object of this invention is to provide the improved methods of the packaging technique for a large FED. It does not need increase any process before the process of the fixing of the spacers on the upper plate.

The further object of this invention is to provide the improved structure of the packaging technique for a large FED. It is very sufficient that the spacers were bonded on the upper plate and the thickness of FED could not increase.

In order to achieve the objects described above, a large size FED includes an ITO conducting glass substrate, which is covered by the first screen mask and the second screen mask defined to a BM layer area, a multi-phosphor layer area and a hollow area. Each area was coated to form an Al layer, which was formed an $AlO_x$ layer through a phosphor sintering process. The spacer was fixed in a hollow area of an $AlO_x$ layer through an anodic assembling technique. The next plate was fixed on the spacer to accomplish an aligner process.

BRIEF DESCRIPTION OF THE DRAWINGS

FIG. 7 illustrates the data of the binding process of the upper plate and the spacers;

DETAILED DESCRIPTION OF THE PREFERRED EMBODIMENT

Figure 1:
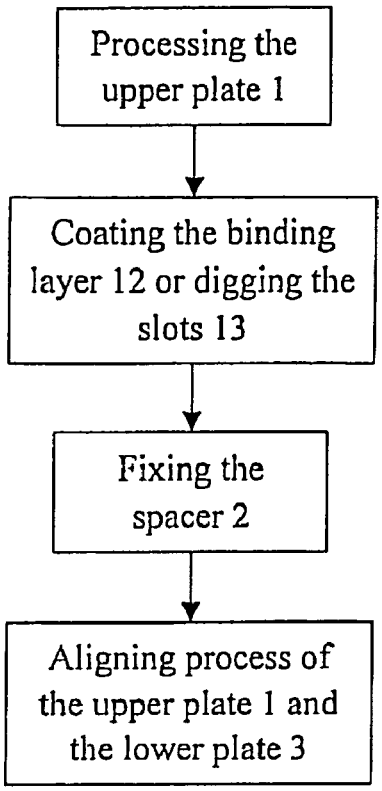
Fig.1 PRIOR ART
FIG. 1 illustrates the flow chart of the process of a known technique.
Figure 4:
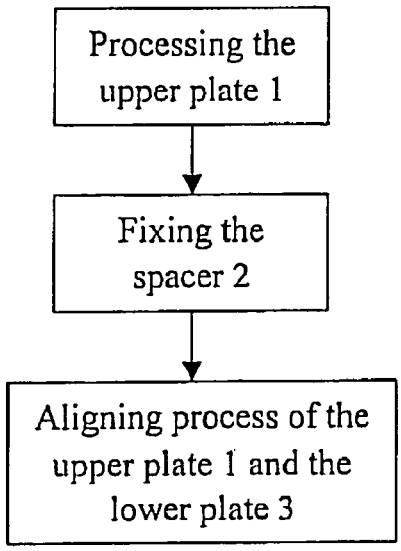
FIG. 4 illustrates the flow chart of the processing of this invention.
Figure 2:
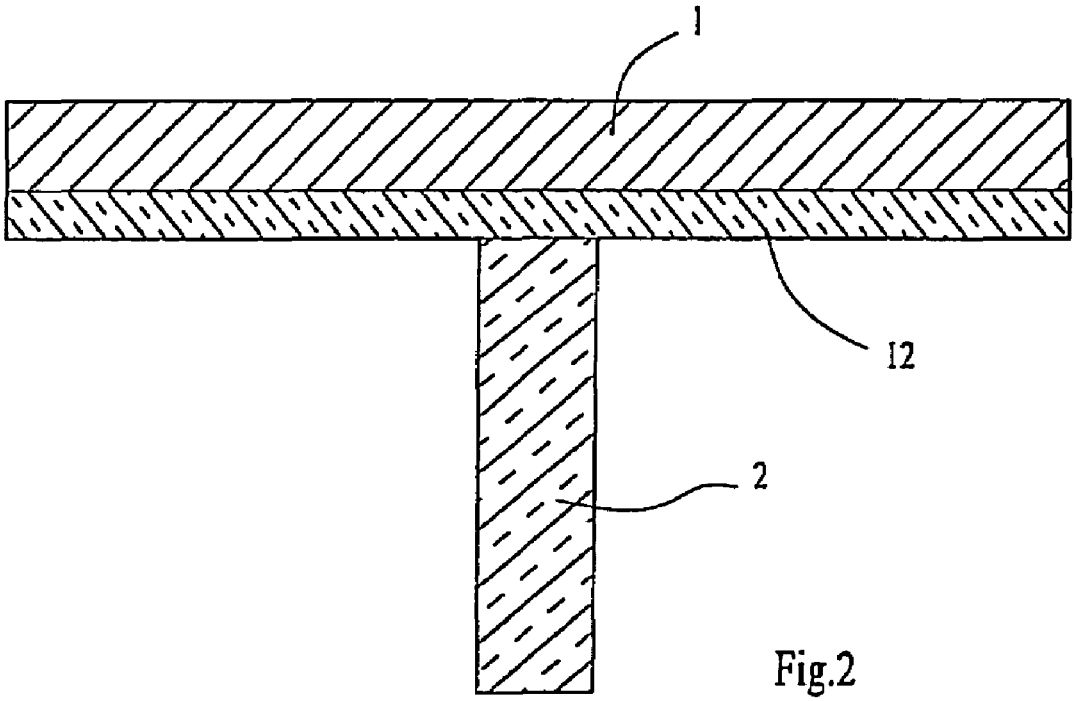
Fig.2 PRIOR ART
FIG. 2 illustrates the cross-sectional view of binding layer fixing on the spacers of a known technique.
Figure 3:
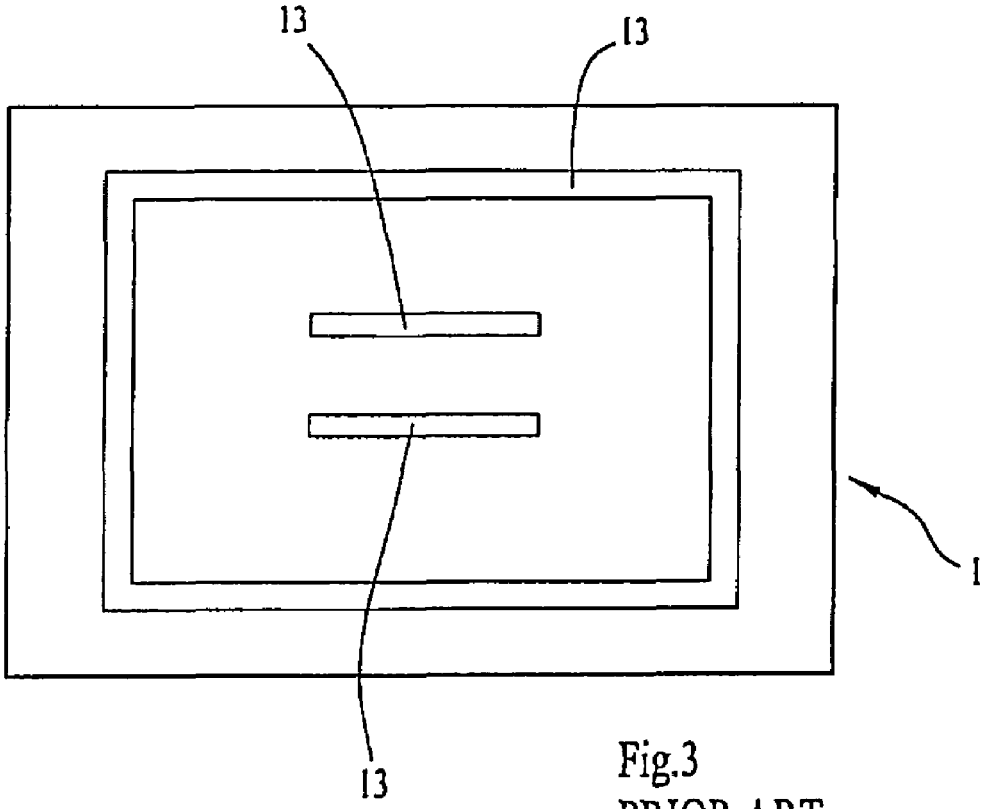
Fig.3 PRIOR ART
FIG. 3 illustrates the bottom view of the slots fixing on the spacers of a known technique.

FIGS. 1–3 show the flow chart of the process of a known technique, the cross-sectional view of binding layer fixing on the spacers of a known technique, the bottom view of the slots fixing on the spacers of a known technique, and the flow chart of the processing of this invention, respectively. As shown in FIGS. 1–4 after processing the upper plate 1 according to the flow chart of the processing of a known technique, it needs the process of coating the binding layer 12 as shown in FIG. 2 or the process of digging slots 13 as shown in FIG. 3. And then it carries out the process of the fixing spacer 2, in which the binding layer 12 is frit to fix the spacer on the upper plate through the binding method. Slots 13 are bound with the spacer 2 on the upper plate readily for the aligner process of the upper plate 1 and the lower plate 3. The flow chart of the processing of this invention as shown in FIG. 4, after processing the upper plate it carries out the fixing process of the spacer 2; it omits the process of coating with the binding layer 12 as shown in FIG. 2 or the process of digging slots 13 as shown in FIG. 3.

FIGS. 5A–5E show the cross-sectional views of the process of the three-dimensional structure of the upper plate 1 for FED of this invention. First, a substrate glass 111 assembles with an ITO layer 112 to form an ITO conducting glass substrate 11, which is covered by the first screen mask (not shown in FIG.) and the second screen mask (not shown in FIG.) defined to a BM layer area 14, a multi-phosphor layer area 15 and a hollow area 16. The inside of a hollow area 16 was coated with a thin $Cr/CrO_x$ layer area 20 of the BM layer. Each area was coated to form an Al layer 17, which was formed an $AlO_x$ layer 18 due to the sintering process of phosphor area 15. X is the equivalence ratio of oxygen component in the aluminum and chromium oxide and its range is from 0.2 to 2.0. The spacers 2 were fixed in a hollow area 16 of an $AlO_x$ layer 18.

ITO conducting glass 11 is a typical industrial available. The first screen mask and the second screen mask on the ITO conducting glass 11 was defined to a BM layer area 14, a multi-phosphor layer area 15, and a hollow area 16. The inside of a hollow area 16 was coated with a $Cr/CrO_x$ layer area 20 of the BM layer. All of these processes are typical known technique and are not described here. Once the defined areas on the ITO conducting glass 11 as described above, which were coated to form an Al layer 17. An Al layer 17 is usually formed through the vacuum evaporation or electron beam evaporation. The thickness of an Al layer 17 is about 1000–3000 angstroms. Then a multi-phosphor layer area 15 was carried out a sintering process at the temperatures of 500–560° C. During the sintering process the surface of an Al layer 17 was forming an $AlO_x$ layer 18, in which the thickness is about 50–200 angstroms. The sintering process described was carried out in a furnace.

A spacer 2, a cross column structure, the height is about 1.1 mm, was fixed in the hollow area 16 of an $AlO_x$ layer 18. Multiple bonding areas are between the spacers 2 and an $AlO_x$ layer. The technique for fixing the spacers 2 on an $AlO_x$ layer 18 is an anodic bonding technique, in which the positive voltage and the negative voltage was connected to the spacer 2 and an Al layer 17, respectively. The intensity of an electric field is around 1.00–1.50 V/μm. The substrate glass was heated on a hot plate 19 at the temperatures of 200–300° C. about 5–10 minutes.

Figure 5A:
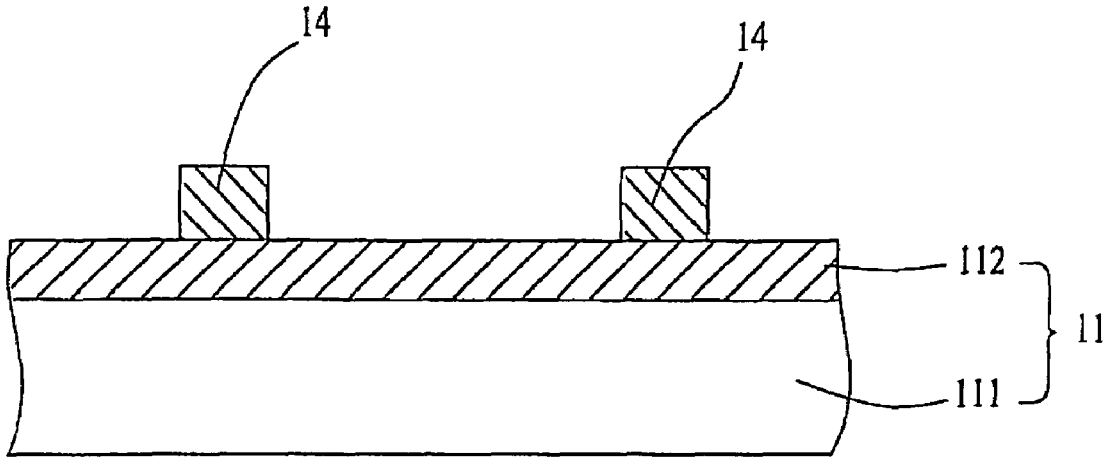
FIG. 5A, FIG. 5B, FIG. 5C, FIG. 5D, and FIG. 5E illustrate the cross-sectional view of the processes of this invention.
Figure 5B:
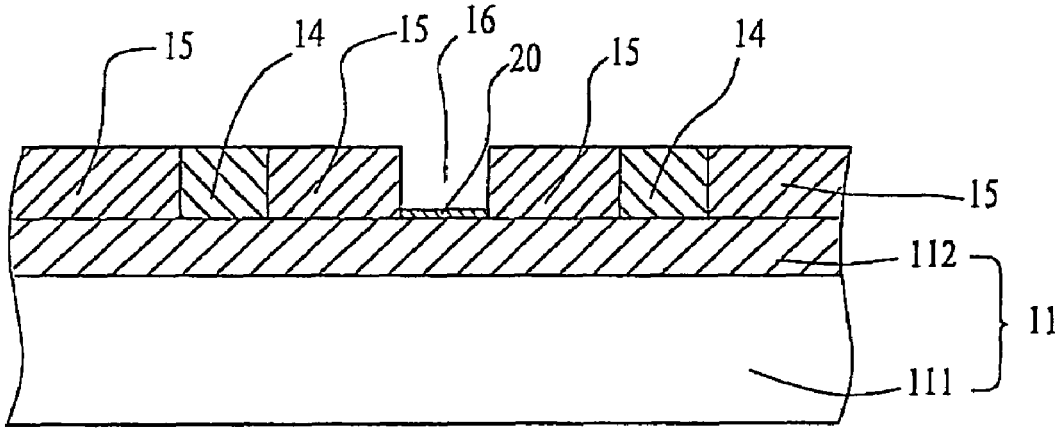
Figure 5C:
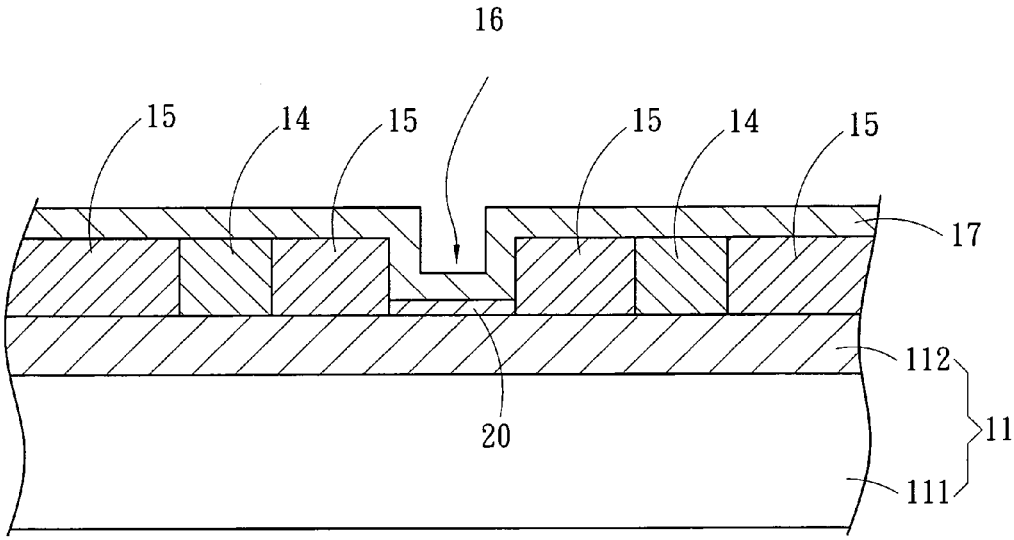
Figure 5D:
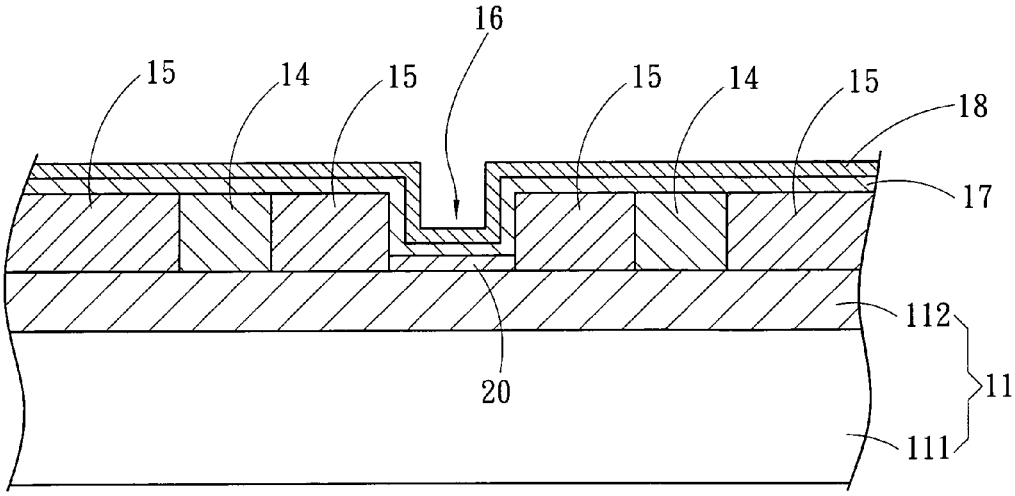
Figure 5E:
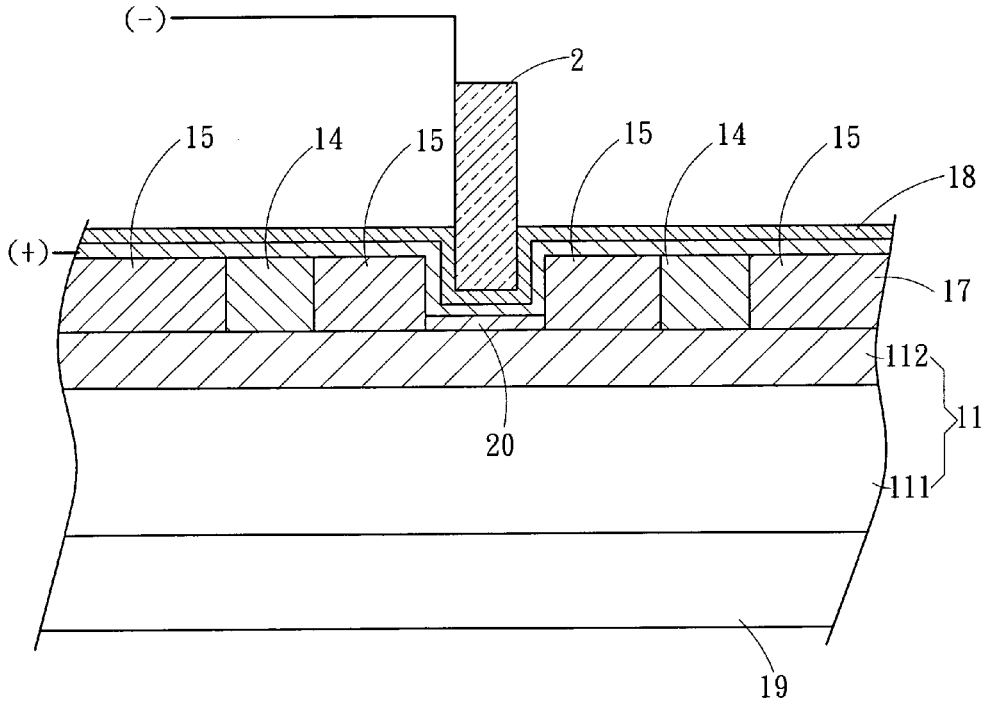
Figure 6:
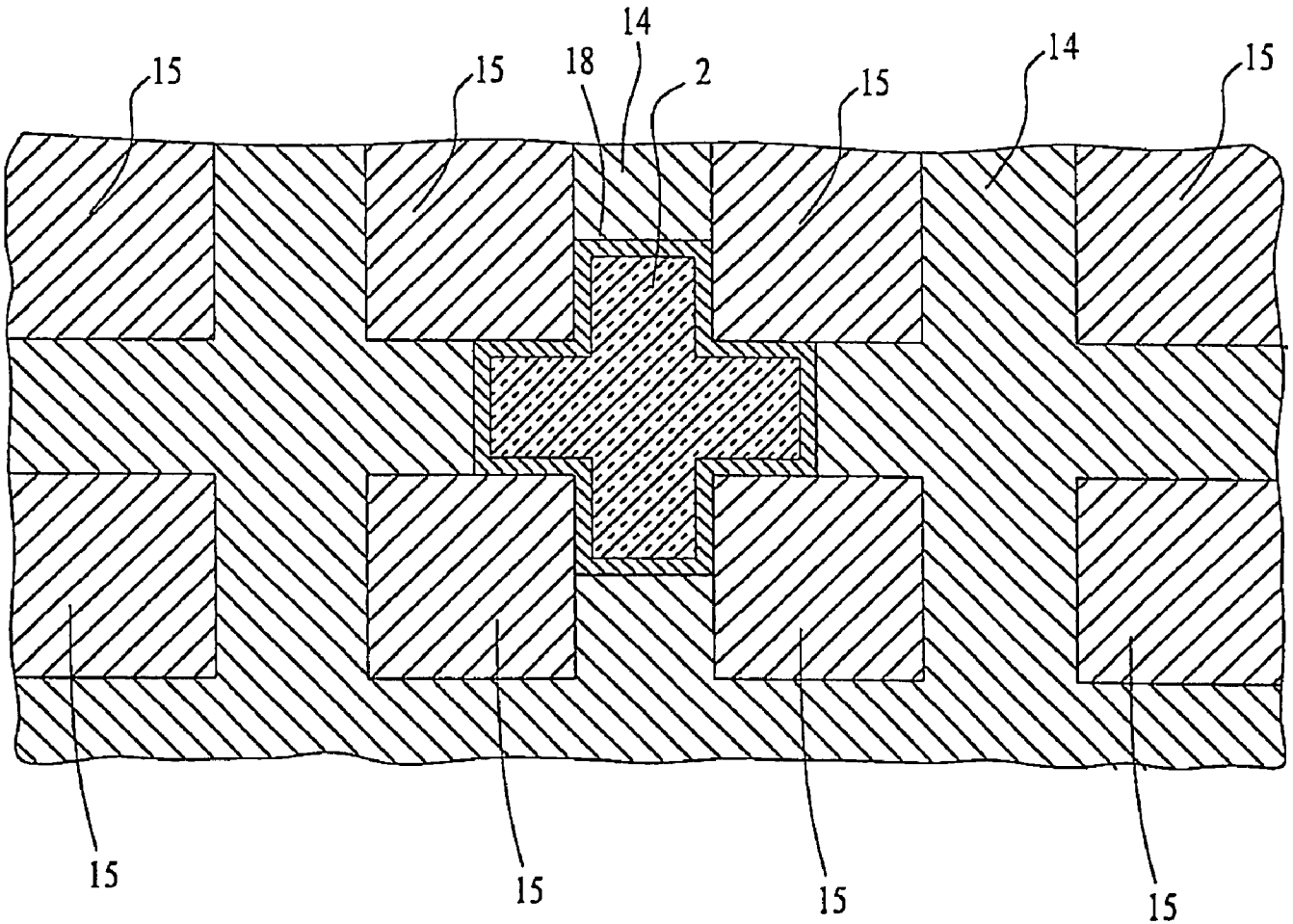
FIG. 6 shows the positions of the spacers, $AlO_x$ layer, phosphor layer, and BM layer of this invention.

FIG. 6 shows the top view of the positions for the spacer 2, an $AlO_x$ layer 18, a multiple phosphor areas 15, and a BM layer area 14. As shown in the figure, the spacer 2 possesses the cross-sectional view of a cross column structure and is positioned in the hollow area 16 (as shown in FIG. 5D) of the phosphor layer 15 and the BM layer area 14. Multiple bonding areas are between the spacers 2 and an $AlO_x$ layer 18, and the number of bonding areas is changed according to the difference of the shapes of the cross-sectional view of the spacer 2.

An ITO conducting glass 11 of the upper plate 1, 470 mm in length, 370 mm in width, and 1.1 mm in thickness, is manufacture by Asahi Japan. The thickness of both BM layer 14 and phosphor layer 15 is 10 μm. The thickness of $Cr/CrO_x$ layer 20 is about 3000 angstroms. The thickness of an Al layer 17 is 3000 angstroms. The thickness of an $AlO_x$ layer 18 is 200 angstroms. The depth of the hollow area 16 is about 7000 angstroms. The spacer 2 is a glass material possessing the cross-sectional view of a cross column structure, in which the height is 1.1 mm, the thickness is 80 μm, and the length of each arm of the cross is 1.0 mm. This kind of the upper plate 1 and the spacer 2 were carrying out an anodic bonding experiment.

FIG. 7 shows the data collected from an anodic bonding process of the upper plate 1 and the spacer 2 of this invention. The upper plate 1 described before and the spacer 2 was carried out an anodic bonding experiment at 300° C. with 1.23 V/μm, and 0.91 V/μm, at 250° C. with 1.23 V/μm and 0.91 V/μm, and at 200° C. with 1.23 V/μm. It was recording an electric current every 20 seconds.

Figure 8:
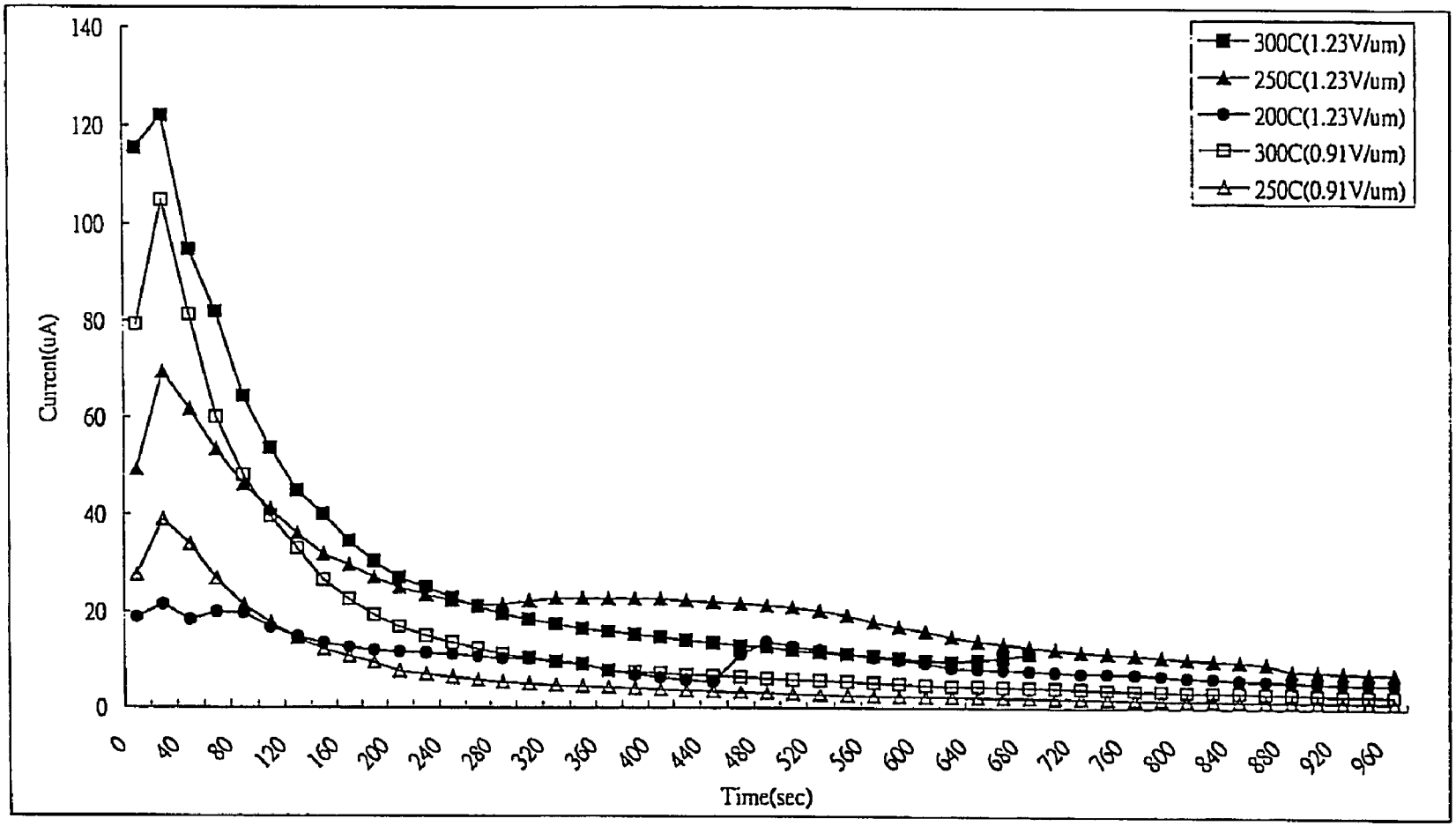
FIG. 8 illustrates the curve of electrical current vs. time during an anodic bonding process of this invention.

FIG. 8 shows the curve diagram of electric current (mA) vs. time (second) during an anodic bonding process. Plotting the diagram of electric current vs. time in accordance with data of FIG. 7, at 300° C. with 1.23 V/μm, and 0.91 V/μm, at 250° C. with 1.23 V/μm and 0.91 V/μm, and at 200° C. with 1.23 V/μm, every curve has the tendency of rising up firstly then dropping down. The highest point of the curve represents the beginning of the breakage of bond between atom and atom, in which the broken bond atoms start moving freely between the spacer 2 and an $AlO_x$ layer 18 at such a temperature and voltage during an anodic bonding process. The bond between atom and atom is broken down sufficiently at the highest point of the curve; at this moment the movement of atoms between the spacer 2 and an $AlO_x$ layer 18 reaches the highest peak, hence, the electric current is the largest. As shown in FIG. 8, the free moving atoms are decreased gradually since the bonding surface is accomplished between an $AlO_x$ layer 18 and the spacer 2; hence, the electric current is dropped down.

When it was carrying out an anodic bonding process at the same temperature such as 300° C. or 250° C. using different voltages such as 1.23 V/μm, and 0.91 V/μm, respectively, the producing electric current at higher voltage is larger than that of at lower voltage. Under the condition of the same voltage 1.23 V/μm or 0.91 V/μm at the different temperatures such as 300° C. and 250° C. using hot plate 19, the producing electric current at higher temperature is larger than that of at lower temperature. Basically, the larger the density of electric current is, the more the efficiency of bonding is.

As shown in FIG. 8 no matter the voltage using 1.23 V/μm or 0.91 V/μm at 300° C. or 250° C. using hot plate 19, it produces the largest electric current in the curve about 60 seconds; however, there is no such as this matter in the curve at 200° C. using hot plate 19 since the energy is still not enough to break down the bonding between atoms each other, hence, atoms between the spacer 2 and an $AlO_x$ layer 18 can not move freely, and the efficiency of an anodic bonding is decreased.

Figure 9:
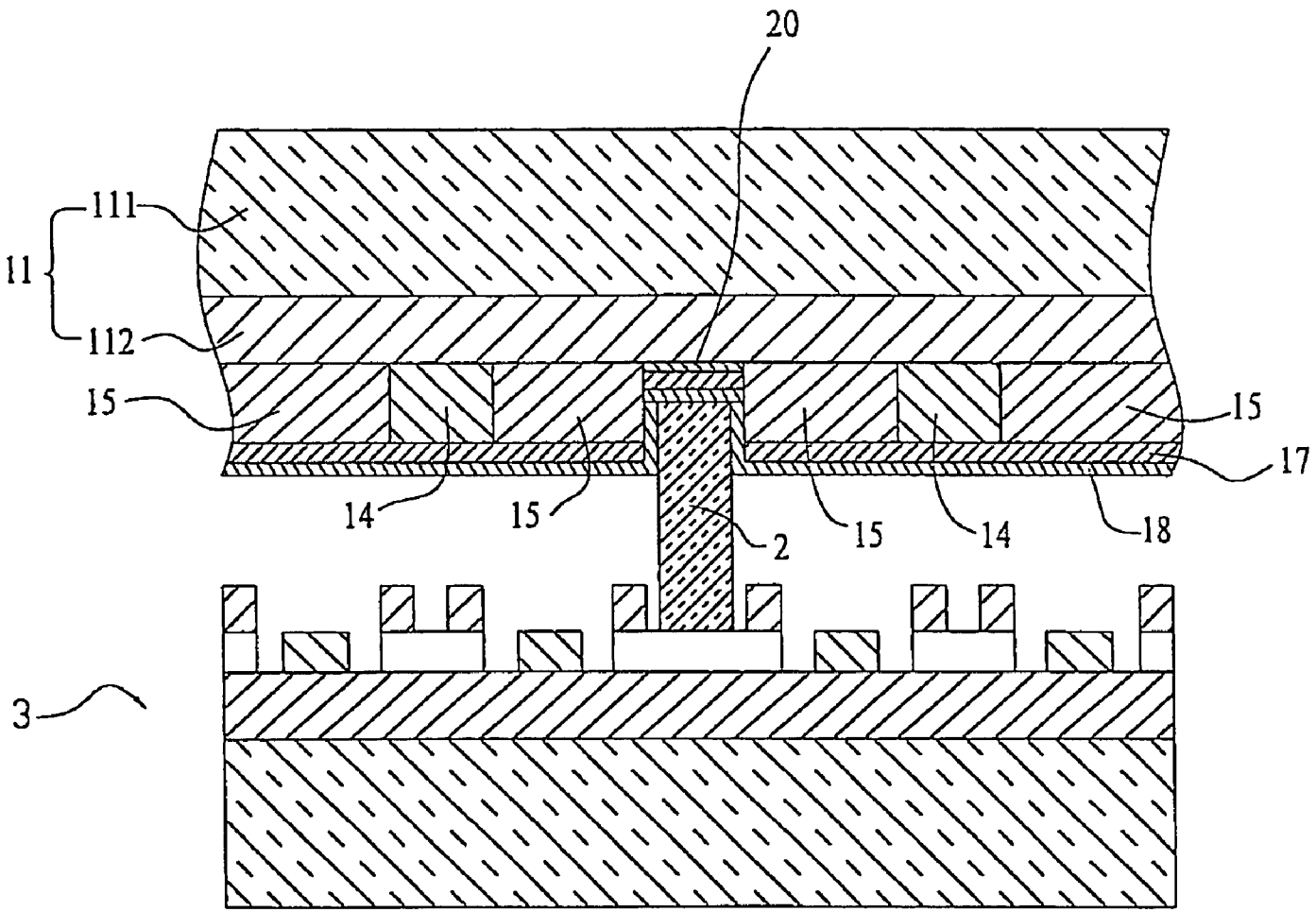
FIG. 9 illustrates the projection of the accomplishment of the aligner process of the upper plate and the lower plate.

FIG. 9 shows the cross-sectional view of the accomplishment of aligner process of the upper plate 1 and the lower plate 3 of this invention, in which the upper plate 1 and the spacer 2 were fixing to each other according to the processing methods and structure of this invention, and readily for the next process.

This invention specially discloses and describes selected the best examples. It is to be understood, however, that this invention is not limited to the specific features shown and described. The invention is claimed in any forms or modifications within the spirit and the scope of the appended claims.

What is claimed is:

1. An improved structure for the packaging technique of a large size FED comprising:

an ITO conducting glass;

on the ITO conducting glass is defined to a BM layer area, a multi-phosphor layer area, and a hollow area, in which the inside of a hollow area is formed a $Cr/CrO_x$ layer area;

said areas are coated with an Al layer;

an Al layer is coated with an $AlO_x$ layer;

a spacer is fixed on an $AlO_x$ layer of the hollow area; and a lower plate is fixed on the spacer.

2. An improved structure for the packaging technique of a large size FED of claim 1, wherein said method of forming an Al layer is an evaporation, and the thickness is around 1000–3000 angstroms.

3. An improved structure for the packaging technique of a large size FED of claim 1, wherein the temperature of the sintering process of the phosphor layer is around 500–560° C.

4. An improved structure for the packaging technique of a large size FED of claim 1, wherein the thickness of the $AlO_x$ layer is around 50–200 angstroms.

5. An improved structure for the packaging technique of a large size FED of claim 1, wherein said the thickness of the $Cr/CrO_x$ layer is around 1000–3000 angstroms.

6. An improved structure for the packaging technique of a large size FED of claim 1, wherein said spacer is form as a column structure, and the height of the spacer is about 1.1 mm.

7. An improved structure for the packaging technique of a large size FED of claim 1, wherein there is a plurality of bonding areas between the spacer and an $AlO_x$ layer.

8. An improved structure for the packaging technique of a large size FED of claim 1, wherein said method of fixing the spacer is an anodic bonding technique.

9. An improved structure for the packaging technique of a large size FED of claim 1, wherein the voltage of fixing the spacer is 1.00–1.50 V/$\mu$m.

10. An improved structure for the packaging technique of a large size FED of claim 1, wherein the temperature of fixing the substrate glass of the spacer is 200–300° C.

11. An improved structure for the packaging technique of a large size FED of claim 1, wherein the range of X, equivalence ratio of oxygen component in the aluminum and chromium oxide, is from 0.2 to 2.0.

* * * * *